US006860967B2

(12) United States Patent
Baumoller et al.

(10) Patent No.: US 6,860,967 B2
(45) Date of Patent: Mar. 1, 2005

(54) TISSUE PAPER PENETRATED WITH SOFTENING LOTION

(75) Inventors: Guido Baumoller, Leichlingen (DE); Rolf Kawa, Monheim (DE); Stephan Eichhorn, Gernsheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 10/051,356

(22) Filed: Jan. 22, 2002

(65) Prior Publication Data

US 2002/0148583 A1 Oct. 17, 2002

Related U.S. Application Data

(60) Provisional application No. 60/262,368, filed on Jan. 19, 2001.

(51) Int. Cl.[7] ..... D06M 13/17; D06M 13/144; D06M 13/224; A61K 7/00; A61K 9/00; D21H 17/72; D21H 17/14; D21H 17/06; D21H 17/24; D21H 17/53

(52) U.S. Cl. ..... 162/158; 162/172; 162/179; 162/135; 162/173; 424/402; 424/443; 424/449; 428/195.1

(58) Field of Search ..... 162/158, 135, 162/172, 179, 173, 164.1, 164.6, 168.1, 168.3, 183–185; 424/400, 402, 443, 449; 428/195.1, 153–154, 375, 480, 211, 195

(56) References Cited

U.S. PATENT DOCUMENTS

| | | | | | |
|---|---|---|---|---|---|
| 1,127,438 | A | | 2/1915 | Holliday | |
| 2,122,716 | A | | 7/1938 | Graves | |
| 2,495,066 | A | | 1/1950 | Jones | |
| 3,264,188 | A | | 8/1966 | Gresham | |
| 3,305,392 | A | | 2/1967 | Britt | |
| 3,619,280 | A | | 11/1971 | Scheuer | |
| 3,814,096 | A | | 6/1974 | Weiss et al. | |
| 3,896,807 | A | | 7/1975 | Buchalter | |
| 4,112,167 | A | | 9/1978 | Dake et al. | |
| 4,202,879 | A | | 5/1980 | Shelton | |
| 4,462,981 | A | | 7/1984 | Smith | |
| 4,481,243 | A | | 11/1984 | Allen | |
| 4,513,051 | A | | 4/1985 | Lavash | |
| 4,550,035 | A | | 10/1985 | Smith | |
| 4,690,821 | A | * | 9/1987 | Smith et al. | 424/401 |
| 4,764,418 | A | | 8/1988 | Kuenn et al. | |
| 4,786,367 | A | | 11/1988 | Bogart et al. | |
| 4,824,689 | A | | 4/1989 | Kuenn et al. | |
| 4,950,545 | A | | 8/1990 | Walter et al. | |
| 4,987,632 | A | | 1/1991 | Rowe et al. | |
| 5,059,282 | A | | 10/1991 | Ampulski et al. | |
| 5,069,897 | A | | 12/1991 | Orr | |
| 5,215,626 | A | | 6/1993 | Ampulski et al. | |
| 5,240,562 | A | | 8/1993 | Phan et al. | |
| 5,312,522 | A | | 5/1994 | Van Phan et al. | |
| 5,334,388 | A | | 8/1994 | Hoang et al. | |
| 5,362,500 | A | | 11/1994 | Mazurek et al. | |
| 5,389,204 | A | | 2/1995 | Ampulski | |
| 5,397,435 | A | | 3/1995 | Ostendorf et al. | |
| 5,415,737 | A | | 5/1995 | Phan et al. | |
| 5,494,731 | A | * | 2/1996 | Fereshtehkhou et al. | 428/211 |
| 5,601,871 | A | | 2/1997 | Krzysik et al. | |
| 5,614,293 | A | | 3/1997 | Krzysik et al. | |
| 5,650,218 | A | | 7/1997 | Krzysik et al. | |
| 5,665,426 | A | | 9/1997 | Krzysik et al. | |
| 5,720,966 | A | | 2/1998 | Ostendorf | |
| 5,763,332 | A | * | 6/1998 | Gordon et al. | 442/84 |
| 5,840,943 | A | | 11/1998 | Ansmann et al. | |
| 5,846,380 | A | * | 12/1998 | Phan et al. | 162/111 |
| 5,871,763 | A | | 2/1999 | Luu et al. | |
| 5,885,697 | A | | 3/1999 | Krzysik et al. | |
| 5,981,044 | A | * | 11/1999 | Phan et al. | 428/212 |
| 6,126,784 | A | * | 10/2000 | Ficke et al. | 162/184 |
| 6,428,794 | B1 | * | 8/2002 | Klofta et al. | 424/401 |
| 6,623,746 | B1 | * | 9/2003 | Wadle et al. | 424/402 |
| 2002/0146561 | A1 | * | 10/2002 | Baumoller et al. | 428/375 |
| 2002/0148583 | A1 | * | 10/2002 | Baumoller et al. | 162/158 |

FOREIGN PATENT DOCUMENTS

| | | |
|---|---|---|
| DE | 485 947 | 11/1929 |
| DE | 490 263 | 1/1930 |
| DE | 1 814 558 | 6/1970 |
| DE | 20 24 051 | 12/1971 |
| DE | 2 129 441 | 12/1972 |
| DE | 34 47 499 A1 | 7/1986 |
| DE | 39 24 898 A1 | 1/1991 |

(List continued on next page.)

OTHER PUBLICATIONS

Cosmetics: Science and Technology, Second Edition, vol. 1, Wiley–Interscience, Bd. 1, 1972, pp. 27–104.

Abbas Alli G. Shaikh, "Organic Carbonates", Chem. Rev., 1996, vol. 96, No. 3, pp. 951–976.

3. edition of "Leitfadens zur Inhaltsstoffdeklaration Kosmetischer Mittel (guidelines for the nomenclature of ingredients in cosmetic agents) herausgegeben vom (edited by) Industrieverband Korperpflege–und Wachmittel e.V. (IKW), Frankfurt", pp. 44–62.

Kirk–Othmer, "Encyclopedia of Chemical Technology", Third Edition, Wiley–Interscience, vol. 8., 1979, pp. 913–915.

*Primary Examiner*—JoséA Fortuna
(74) *Attorney, Agent, or Firm*—Young & Thompson

(57) ABSTRACT

A tissue paper penetrated with a lotion composition being a liquid, viscous W/O emulsion includes (A) 20 to 75 weight % of at least one oil, (B) 3 to 40 weight % of at least one non-ionic W/O emulsifier, (C) optionally 0.5 to 10 weight % of at least one wax, (D) 1 to 15 weight % of at least one humectant, (E) 6 to 25 weight % of water. The lotioned tissue paper of the invention shows an excellent surface softness and in particular bulk softness. Simultaneously it is capable of efficiently transferring lotion to the skin of the user.

13 Claims, No Drawings

FOREIGN PATENT DOCUMENTS

| | | | | | |
|---|---|---|---|---|---|
| DE | 198 15 086 | | | 10/1999 | |
| DE | 198 21 402 | | | 11/1999 | |
| DE | 198 25 462 | A1 | | 12/1999 | |
| DE | 198 27 661 | | | 12/1999 | |
| DE | 198 43 876 | A1 | | 4/2000 | |
| DE | 199 06 081 | A1 | | 8/2000 | |
| EP | 0 033 448 | A1 | | 8/1981 | |
| EP | 0 049 354 | A2 | | 4/1982 | |
| EP | 0 186 208 | B1 | | 7/1986 | |
| EP | 0 211 773 | A2 | | 2/1987 | |
| EP | 0 347 153 | A2 | | 12/1989 | |
| EP | 0 347 154 | A2 | | 12/1989 | |
| EP | 0 347 176 | A2 | | 12/1989 | |
| EP | 0 347 177 | A2 | | 12/1989 | |
| EP | 0 350 275 | A2 | | 1/1990 | |
| EP | 0 759 291 | A1 | | 2/1997 | |
| EP | 0 766 661 | | | 4/1997 | |
| EP | 0 803 012 | B1 | | 10/1997 | |
| EP | 0 938 886 | A2 | | 9/1999 | |
| EP | 0 950 705 | A1 | | 10/1999 | |
| EP | 1 029 977 | A1 | | 8/2000 | |
| EP | 1 077 672 | | | 2/2001 | |
| EP | 1225276 | A1 | * | 7/2002 | ..... D21H/21/22 |
| EP | 1225277 | A1 | * | 7/2002 | ..... D21H/21/22 |
| GB | 1 333 475 | | | 10/1973 | |
| GB | 1 424 692 | | | 2/1976 | |
| GB | 2 033 751 | A | | 5/1980 | |
| GB | 2 066 661 | A | | 7/1981 | |
| GB | 2 069 333 | A | | 8/1981 | |
| GB | 2 103 089 | A | | 2/1983 | |
| JP | 59 144 426 | A2 | | 8/1984 | |
| JP | 61 289 016 | | | 12/1986 | |
| JP | 62-87117 | | | 4/1987 | |
| JP | 01 093 506 | A2 | | 4/1989 | |
| JP | 02 032 011 | A2 | | 2/1990 | |
| JP | 02 104 511 | A2 | | 4/1990 | |
| JP | 04 005 224 | A2 | | 1/1992 | |
| JP | 4 009 121 | A | | 1/1992 | |
| JP | 5-156596 | | | 6/1993 | |
| JP | 07 002 615 | A2 | | 1/1995 | |
| JP | 08 196 461 | A2 | | 8/1996 | |
| JP | 10 023 988 | A2 | | 1/1998 | |
| JP | 10 226 986 | A | | 8/1998 | |
| WO | WO 93/02252 | | | 2/1993 | |
| WO | WO 94/05856 | | | 3/1994 | |
| WO | WO 94/05857 | | | 3/1994 | |
| WO | WO 94/26971 | | | 11/1994 | |
| WO | WO 94/26974 | | | 11/1994 | |
| WO | WO 95/16824 | | | 6/1995 | |
| WO | WO 95/35411 | | | 12/1995 | |
| WO | WO 95/35412 | | | 12/1995 | |
| WO | WO 96/08601 | | | 3/1996 | |
| WO | WO 96/14835 | | | 5/1996 | |
| WO | WO 96/24329 | | | 8/1996 | |
| WO | WO 96/24719 | | | 8/1996 | |
| WO | WO 96/25557 | | | 8/1996 | |
| WO | WO 96/34035 | | | 10/1996 | |
| WO | WO 97/03645 | | | 2/1997 | |
| WO | WO 97/04171 | | | 2/1997 | |
| WO | WO 97/06306 | | | 2/1997 | |
| WO | WO 97/06307 | | | 2/1997 | |
| WO | WO 97/30216 | | | 8/1997 | |
| WO | WO 97/30217 | | | 8/1997 | |
| WO | WO 97/40814 | | | 11/1997 | |
| WO | WO 97/40815 | | | 11/1997 | |
| WO | WO 97/46205 | | | 12/1997 | |
| WO | WO 98/29602 | | | 7/1998 | |
| WO | WO 98/29605 | | | 7/1998 | |
| WO | WO 98/41687 | | | 9/1998 | |
| WO | WO 99/05246 | | | 2/1999 | |
| WO | WO 99/08555 | | | 2/1999 | |
| WO | WO 99/12519 | | | 3/1999 | |
| WO | WO 99/13861 | | | 3/1999 | |
| WO | WO 99/25318 | | | 5/1999 | |
| WO | WO 99/39682 | | | 8/1999 | |
| WO | WO 99/45771 | | | 9/1999 | |
| WO | WO 00/04230 | | | 1/2000 | |
| WO | WO 00/64407 | | | 11/2000 | |
| WO | WO 00/64408 | | | 11/2000 | |
| WO | WO 00/64409 | | | 11/2000 | |

* cited by examiner

TISSUE PAPER PENETRATED WITH SOFTENING LOTION

This application claims benefit of 60/262,368 filed Jan. 19, 2001.

FIELD OF INVENTION

The invention relates to a soft lotioned tissue paper, in particular, to a soft lotioned tissue paper having bulk softness due to a specific lotion composition which penetrates tissue paper.

BACKGROUND ART

Based on the underlying compatibility of the production processes (wet laying), "tissue" production is counted among the paper making techniques. The production of tissue is distinguished from paper production by its extremely low basis weight of normally less than 65 g/m$^2$ and its much higher tensile energy absorption index. The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). In the latter technique, often referred to as "(wet) rush transfer", for instance the forming fabric of the paper machine is moved at greater speed than that of the fabric to which the formed paper web is transferred, for instance a transfer fabric or a TAD fabric (through air drying), so that the paper web is somewhat bundled when it is taken up by the transfer fabric. Many prior art documents (e.g. EP-A-0 617 164, WO-94/28244, U.S. Pat. No. 5 607 551, EP-A-0 677 612, WO-96/09435) refer to this as "inner creping", when they describe the production of "uncreped" tissue paper by rush transfer techniques. The inner and outer creping causes the still moist, plastically deformable paper web to be internally broken up by compression and shearing, thereby rendering it more stretchable under load than uncreped paper. Most of the functional properties typical of tissue and tissue products result from a high tensile energy absorption index (see DIN EN 12625-4 and DIN EN 12625-5). Typical properties of tissue paper include the ready ability to absorb tensile stress energy, their drapability, good textile-like flexibility, a high specific volume with a perceptible thickness, as high a liquid absorbency as possible and, depending on the application, a suitable wet and dry strength as well as an interesting visual appearance of the outer product surface.

Softness is an important property of tissue products such as handkerchiefs, cosmetic wipes, toilet paper, serviettes/napkins, not to mention hand or kitchen towels, and it describes a characteristic tactile sensation caused by the tissue product upon contact with the skin.

Although the term "softness" is generally comprehensible, it is extremely difficult to define because there is no physical method of determination and, consequently no recognized industrial standard for the classification of different degrees of softness.

To be able to detect softness at least semi-quantitatively, softness is determined in practice by means of a subjective method. To do so, a "panel test" is carried out in which several trained test persons give a comparative opinion.

In simplified terms, softness can be subdivided into its main characteristics, surface softness and bulk softness. Surface softness describes the feeling perceived when e.g. one's fingertips move lightly over the surface of the sheet of tissue. Bulk softness is defined as the sensory impression of the resistance to mechanical deformation that is produced by a tissue or tissue product manually deformed by crumpling or folding and/or by compression during the process of deformation.

One method for increasing bulk softness of tissue paper as taught by WO 96/25557 involves a) wet-laying an aqueous slurry containing cellulosic fibres to form a web b) applying a water soluble polyhydroxy compound to the wet web, and c) drying and creping the web (wet web addition method).

It is further known from U.S. Pat. No. 4,764,418 that some humectants such as polyethylene glycol contribute to the softness of tissue products if they are applied to a dry web.

The use of humectants, such as polyhydroxy compounds, in highly concentrated form, as softeners however, has the disadvantage that the humectant may, upon contact, draw too much moisture from the skin, for instance when blowing one's nose with a tissue handkerchief. Moreover the softening effect is not yet satisfactory.

WO 96/24723 teaches increasing the surface softness of tissue paper by applying discrete deposits of a water free lotion composition containing an oil and a wax. Since however, due to its solid consistency, the treatment composition remains on the surface of the tissue paper, it cannot contribute to bulk softness. Further, water-free lotion compositions based on waxy or oily materials often feel unpleasantly greasy or oily.

Moreover, water-free lotions such as the one in WO 96/24723 often do not feel particularly pleasant to the skin which is due to a low moisture content.

EP A 1 029 977 relates to a composition for treating paper products, such as tissue products, comprising between 30 and 90% by weight of oil, between 1 and 40% by weight of wax, between 1 and 30% by weight of an emulsifying agent and between 5 and 35% by weight of water. This lotion composition is solid or semisolid at 30° C. and remains primarily at the surface of the tissue paper, although it penetrates the tissue paper somewhat more than the solid composition of WO 96/24723.

DE 199 06 081 A1 discloses emulsions containing (a) 5 to 25% by weight polyol poly-12-hydroxy stearate, (b) 50 to 90% by weight waxy esters and (c) 5 to 25% by weight waxes. This document further contains examples describing the treatment of tissue papers with W/O emulsions as defined above containing about 20 to 25% water. These compositions are solid or semisolid at 30° C. (example 1 corresponds to lotion F of EP A 1 029 977) and show the same penetration behaviour as described above for the lotions of EP A 1 029 977.

One object of the present invention involves providing a treated tissue paper that overcomes the disadvantages of prior art formulations.

In particular, the present invention aims at providing a tissue paper treated with a lotion composition which remains stable while enhancing softness, in particular, bulk softness of the tissue product.

A further technical object of the present invention is to provide a lotioned tissue paper which feels very pleasant to the skin and is not oily or greasy to the touch.

SUMMARY OF THE INVENTION

This technical object is solved by a tissue paper penetrated with a lotion composition comprising (A) 20 to 75 weight % of at least one oil, (B) 3 to 40 weight % of at least one non-ionic W/O emulsifier, (C) optionally 0.5 to 10 weight % of at least one wax, (D) 1 to 15 weight % of at least one humectant, (E) 6 to 25 weight % of water, wherein the weight % values relate to the total weight of the lotion composition. This lotion is a viscous liquid at room temperature (23° C.). Its fairly low viscosity in comparison to known semi-solid lotion compositions for tissues contributes to an excellent penetration behaviour and prevents it from remaining on the surface of a single or multi-ply tissue product. In the case of single-ply tissues, it fully penetrates and softens the ply. In the case of multi-ply products, the lotion composition reaches the inner plies which greatly enhances bulk softness. Moreover, the lotion is capable of transferring active agents to the skin of the user, if necessary.

DETAILED DESCRIPTION OF THE INVENTION

The lotioned tissue paper of the invention is typically obtained by applying the aforementioned lotion composition to a dry tissue web (without lotion). Preferably, the residual water content of the tissue web is no more than 10% by weight.

1. Lotion

By mixing and homogenizing oil, liquid non-ionic emulsifier, humectant, water, and optionally wax, an water-in-oil (W/O) emulsion is obtained which preferably has a viscosity of less than 10,000 mpa·s at 23° C., a value typical of semi-solid lotions (measured with a Brookfield-RVF viscosimeter, spindle 5, 10 rpm; hereinafter viscosity values of the final lotion composition always relate to the measurement with a Brookfield-RVF viscosimeter, spindle 5, 10 rpm). Preferably, it has a viscosity of less than 7,500 mPa·s, more preferably 1,500 to 5,000 mPa·s, in particular, 2,000 to 3,500 mPa·s, measured at 23° C. Further, it is preferred that the viscosity at 30° C. ranges from 800 to 2,500 mPa·s in particular, 1,000 to 2,200 mPa·s. At a temperature of 40° C., preferred viscosity values are 500 to 1,500 mPa·s, in particular, 600 to 1,200 mPa·s. At 50° C., the lotion preferably has a viscosity of less than 500, in particular less than 400 mPa·s.

Despite the low viscosity, the lotion composition is stable during preparation and use, and does not separate into the water and oil phase.

The low viscosity of the lotion is enhanced by the use of a fairly small amount of solid components. Hereinafter, the term "solid" or "liquid" refers to the physical state at room temperature (23° C.). Typically, the overall content of solid components is less than 15% by weight, in particular, less than 10% by weight, based on the total weight of the lotion composition.

The melting range of the solid components, as measured according to DSC analysis of the final lotion composition, preferably lies within the temperature range of 250 to 70° C., in particular 30° to 60° C.

This lotion does not require the presence of silicone containing compounds, e.g. silicone oils or quaternary amine compounds in order to attain its softening effect, although their use is not excluded.

1.1. Oil Component (A)

The term "oil" is used for water-insoluble, organic, natural and synthetic, cosmetically useful oils having preferably a liquid consistency at room temperature (23° C.). The oil component is used in an amount of 20 to 75 weight %, preferably 30 to 60% by weight. (Hereinafter, unless stated otherwise, weight % values always relate to the total weight of the lotion composition).

The oil component is suitably selected from among known oils from plant sources, mineral oils, or synthetic oils.

Preferably, the oil component (A) contains at least one oil selected from among the following types:

Glycerides, which are mono-, di- and/or tri ester (fatty acid ester) of glycerol (in particular di- and/or triester). Glycerides can be obtained by chemical synthesis or from natural sources (plant or animal) as known in the art. Preferably the fatty acid component has from 6 to 24, more preferably 6 to 18, in particular 8 to 18 carbon atoms. The fatty acid can be branched or unbranched as well as saturated or unsaturated. According to the invention the use of liquid glycerides from plant sources is preferred, in particular the use of a modified liquid coconut oil (INCI name: cocoglycerides, available under the trade name myritol® 331 from Cognis Deutschland GmbH) which contains as main component a mixture of di- and triglycerides based on CB to C18 fatty acids.

Natural plant oils which may contain liquid glycerides as main component, such as soja oil, peanut oil, olive oil, sunflower oil, macademia nut oil or jojoba oil.

Symmetric or asymmetric, linear or branched dialk(en)ylethers having from 6 to 24 carbon atoms (per alk(en)yl group, preferably having 12 to 24 C atoms as total number of C atoms), such as di-n-octylether (dicaprylylether), di-(2-ethylhexylether, laurylmethylether, octylbutylether or didocecylether, the use of di-n-octylether (dicaprylylether; viscosity: 2–5 mPaS at 20° C.; DGF method described below) being preferred.

Dialk(en)ylcarbonates having preferably at least one C6 to 22 alkyl or alkenyl group (preferred total number of C atoms: not more than 45, including the C atom of the carbonate unit). The alkyl or alkenyl group can be straight or branched. The alkenyl unit may display more than one double bond. They can be obtained by transesterification of dimethyl or diethyl carbonate in the presence of C6 to C22 fatty alcohols according to known methods (cf. Chem. Rev. 96, 951 (1996)). Typical examples for dialk(en)ylcarbonates are the (partial) transesterification products of caprone alcohol, capryl alcohol, 2-ethylhexanol, n-decanol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachidyl alcohol, gadoleyl alcohol, behenyl alcohol, erucyl alcohol and brassidyl alcohol as well as their technical mixture, which are for instance obtained by high pressure hydrogenisation of technical methyl ester(s) on fat or oil basis. Particularly suitable in view of their low viscosity at 20° C. are dihexyl-, dioctyl-, di-(2-ethylhexyl)- or dioleylcarbonat a (viscosity of dioctylcarbonate: 7 mPaS at 20° C.; DGF method described below). Thus it is preferred to use either short chain (C6 to C10) alkyl or alkenyl carbonates.

Hydrocarbon-based oils having preferably from 8 to 30, in particular 15 to 20 carbon atoms, such as squalane, squalenen, paraffinic oils, isohexadecane, isoeicosane, polydecene or dialkycyclohexane, or mineral oil.

Further, the oil component is preferably selected (depending on chain length or esterification degree as known from the prior art) such that its polarity is not greater than 5, in particular not greater than 4 Debey.

In a further preferred embodiment, the oil component preferably is suitably selected among low viscosity oils, i.e. oils having a viscosity of 1–100 mP·s, ini particular 1–50 mp·s (e.g. 1–20 mP·S) measured with a Hoppler falling sphere viscosimeter at 20° C. (method "Deutsche Gesellschaft fur Fettchemie" DGF C-IV 7), in order to achieve the desired penetration behaviour on tissue.

Moreover, it is preferred that the oil component (A) comprises (preferably at least 20% by weight, in particular at least 40% by weight, based on the oil component) at least one "oil (A')" which is preferably selected from oils having a viscosity lower than 30 mPa·s measured with a Hoppler falling sphere viscosimeter at 20° C. (method DGF C-IV 7), and/or from symmetric or asymmetric dialk (en)ylethers having from 6 to 24 C atoms (per alkyl group) and preferably 12 to 24 C atoms in total, or linear or branched dialk(en)ylcarbonates derived from C 6 to 22 fatty alcohols. The viscosity of these oils is preferably less than 20, more preferably less than 15, in particular less than 10 mPa·s measured as above.

In a further preferred embodiment the oil component (A) comprises (preferably at least 20% by weight, in particular at least 40% by weight, based on the oil component) at least one "oil (A")", preferably having a viscosity greater than oil A', in particular greater than 30 mPa·s (preferably at least 40 mPa·s) and not more than 100 mPa·s measured with a Hoppler falling sphere viscosimeter at 20° C. (method DGF C-IV 7),and/or being at least one oil (A") selected from glycerides, natural oils and hydrocarbon based oils.

It is preferred to use the oils (A') and (A") in combination, in particular a mixture of (A') dialk(en)ylethers or dialk(en) ylcarbonates and (A") glycerides, hydrocarbon-based oils or natural oils. The use of dialk(en)ylethers and glycerides in combination is particularly preferred.

If one of these oils is used as part of the oil component (A), its weight proportion preferably is at least 20% by weight, in particular at least 40% by weight based on the total amount of the oil component.

In a particularly preferred embodiment, the oil component (A) comprises 20 to 80% in particular 40 to 60% by weight of a liquid glyceride and 80 to 20% by weight, in particular, 60 to 40% by weight of a liquid dialk(en)ylether.

1.2. W/O Emulsifier

The emulsifier or emulsifier composition (B) is of a non-ionic type and primarily has the function of forming a water-in-oil emulsion. It can also contribute to the softness of tissue paper. Preferably, it has a HLB value of 2.5 to 10, in particular 2.5 to 5.

Its content is 3 to 40% by weight, more preferably 10 to 30 and 10 to 25, in particular 15 to 25% by weight. Preferably a liquid W/O emulsifier is used, although the use of minor amounts of a solid emulsifier is possible, as long as the viscosity of the resulting lotion composition is not too high.

Component (B) can be suitably selected from a liquid polyol polyester (other than the coemulsifier described below) wherein a polyol having at least two hydroxy groups is esterified with at least one carboxylic acid having from 6 to 30 carbon atoms. Polyols include monosaccharides, disaccharides, and trisaccharides, sugar alcohols, other sugar derivatives, glycerol, and polyglycerols, e.g. diglycerol, triglycerol, and higher glycerols. Such polyol preferably has from 3 to 12, in particular 3 to 8 hydroxy groups and 2 to 12 carbon atoms (on average, if it is a mixture as in polyglycerols). The polyol preferably is polyglycerol, in particular that having the specific oligomer distribution described in WO 95/34528.

The carboxylic acid used in the polyol polyester preferably is a fatty acid having from 6 to 30 carbon atoms (Hereinafter, unless stated otherwise, the term "fatty acid" is not limited to the naturally occurring, even-numbered, saturated or unsaturated long-chain carboxylic acids, but also includes their uneven-numbered homologues or branched derivatives thereof. Unless stated otherwise, the fatty acid has from 6 to 30 carbon atoms, preferably from 6 to 24 carbon atoms). Particularly preferred is a fatty acid containing at least one hydroxy group, a mixture or condensation products (poly(hydroxy fatty acids)) thereof. The preferred carbon range for the above mentioned carboxylic acid, as well as for fatty acids or hydroxy fatty acids, is from 12 to 24, in particular 16 to 18. A particularly preferred poly (hydroxy fatty acid) is the condensation product of hydroxy stearic acid, in particular 12-hydroxy stearic acid, optionally in admixture with poly(ricinoleic acid), said condensation product having the properties described in WO 95/34528.

Preferred emulsifiers include the polyol poly (hydroxystearates) described in WO 95/34528, in particular polyglycerol poly(hydroxystearates) having the characteristics disclosed in this document, e.g. polyglycerol poly (12-hydroxy stearate). This product is commercially available from Cognis Deutschland GmbH under the tradename Dehymuls PGPH.

The weight ratio of the W/O emulsifier to the oil component preferably ranges from 0.2 to 2.0.

1.3. Coemulsifier (optional)

In a further preferred embodiment, the lotion composition contains a nonionic coemulsifier in an amount of up to 15% by weight, more preferably 1 to 10% by weight and in particular 3 to 10% by weight, based on the total amount of the lotion composition. In order to stabilize the W/O emulsion, it is preferred to employ nonionic coemulsifiers selected from the group of lipophilic surfactants having a HLB value of 1 to 8. Such surfactants are known in the art and are, for instance, enumerated in Kirk-Othmer, Enclypedia Of Chemical Technology, third edition, 1979, volume 8, page 913. In the case of ethoxylated products, the HLB value can be calculated according to the formula HLB=(100-L):5, wherein L is the weight proportion of lipophilic groups, e.g. the fatty alkyl of fatty acyl groups.

The combined use of the nonionic W/O emulifier(s) (B) and the coemulsifier leads to very finely dispersed emulsions, thus increasing the stability of the lotion compositon.

A preferred coemulsifier may be selected from

A liquid (partial) ester derived from sugar alcohols It such as erythritol, xylitol, malitol, mannitol and sorbitol and anhydrides of sugar alcohols such as sorbitan. The ester preferably has not more than three ester groups which are derived from carboxylic acids having 6 to 30 carbon atoms, in particular fatty acids as defined above. The fatty acids preferably contain at least one unsaturated unit. Most preferably, the liquid ester represents a sorbitan ester, in particular one derived from a short chain saturated fatty acid, e.g. sorbitan monolaurate or a fatty acid having at least one unsaturated fatty acid, preferably one having from 16 to 22 carbon atoms, such as oleic acid. A particularly preferred sorbitan ester is sorbitan sesquioleate.

The HLB number of the above described liquid (partial) ester preferably lies within the range of from 3 to 9, in particular 3 to 5.

Mixed esters obtainable by esterifying a) at least one fatty acid having 6 to 30, preferably 6 to 22 carbon atoms, such as coconut oil acids, b) a neopentyl alcohol such as neopentylglycol, dimethylolpropane, or preferably pentaerythritol c) at least one fatty alcohol having a carbon number of 6 to 30 carbon atoms, preferably 16 to 20 carbon atoms, such as stearic alcohol, and d) a tricarboxylic acid having no more than 10 carbon atoms and preferably at least one hydroxy group such as citric acid, preferably those of DE-A-11 65 574, e.g. Dicocoyl pentaerythrityl distearyl citrate, which is a solid.

It is preferred to use each of the above optional components in amounts of 1.5 to 7.5% by weight, e.g. 3.5 to 5% by weight, based on the total weight of the lotion composition.

In a particular preferred embodiment 3.5 to 7.5% by weight of the above liquid ester of a sugar alcohol or anhydride thereof is used. It is particularly preferred to use the above described two coemulsifiers in combination with polyglyerol poly(12-hydroxystearate).

1.4. Metal Soaps (Optional)

In order to stabilize the W/O emulsion, further a metal soap of the following preferred formula may be used (up to 10% by weight), preferably in an amount of 0.5 to 5, in particular 0.5 to 4% by weight:

$$(R^1COO)_n—X$$

wherein $R^1$ represents a linear, saturated or unsaturated acyl residue having 6 to 22 carbon atoms and optionally a hydroxy group, preferably 12 to 18 carbon atoms, X is an alkali metal (e.g. Li), an earth alkali metal (e.g. Ca, Mg), Al or Zn and n is the valence of X. Preferred examples of the metal soap involve zinc, calcium, magnesium or aluminium stearate.

1.5. Wax (optional)

In order to adjust the Theological and/or viscosity properties of the final lotion composition, it may be desirable to incorporate at least one wax in an amount of up to 10% by weight, preferably 0.5 to 10% by weight, in particular, 0.5 to 4% by weight.

The term "wax" (sometimes referred to as "lipophilic" waxes) is used as in the art for natural or synthetic materials which have a kneadable, solid or brittle consistency at room temperature, a fine to granular crystallinity (but are not glass-like), and a transparent to opaque appearance. Useful waxes melt at a temperature above 35° C. without decomposing and slightly above the melting point have a fairly low viscosity.

Useful waxes are listed in DE-A 199 06 081. The use of natural waxes, in particular bees wax is preferred.

As a partial or complete substitute for the wax, fatty alcohols (C12 to C24) may be used which not only behave in a wax-like manner, but also have similar effects on the consistency of the final composition.

1.6. Humectant

The lotion composition comprises from 1 to 15% by weight and in particular, 5 to 10% by weight (water-soluble) humectant.

The humectant performs multiple functions. First, it binds water and counteracts the tendency of water to evaporate. Moreover, the humectant interacts with other lotion components and contributes to the softness of the tissue paper, in particular its bulk softness.

The humectant preferably is a polyhydroxy compound, which is understood to be an organic compound having at least two hydroxy groups and which preferably consists only of carbon, hydrogen, oxygen and nitrogen, in particular only of C, H and O. It is further desirable that the humectant is not ionic.

Although hydrophilic surfactants (having a HLB number of 10 or greater, see for instance U.S. Pat. No. 4,764,418) can have humectant properties, it is preferred according to the invention that the humectant be free of major hydrophobic molecule parts, e.g. fatty acid or fatty alcohol residues.

Further, the humectant preferably has a liquid consistency, even though it is possible to use a minor amount of a solid, low melting point humectant if the weight proportion of the remaining solid lotion ingredients is low.

If liquid humectants are to be employed, the molecular weight (weight average) preferably is less than 1,000, more preferably less than 800, and in particular not more than 600.

Examples of suitable humectants include: glycerol, polyalkylene glycols, e.g. polyethylene glycol or polypropylene glycol, for instance polyethylene glycol having a weight average molecular weight of from about 200 to 600; neopentyl alcohols such as pentaerythritol or neopentyl glycol; sugar alcohols such as threitol, erythritol, adonitol (ribitol), arabitol, xylitol, dulcitol, mannitol and sorbitol, carbohydrates such as D (+)-glucose, D (+)-fructose, D (+)-galactose, D (+)-mannose, L-gulose, saccharose, galactose, maltose, polyglycerols, polyoxypropylene adducts of glycerol, methoxypolyethylene glycol, polyethylene glycol ethers of sugar alcohols, such as sorbitol, polyethylene glycol ethers of glycerol, and combinations thereof. Hyaluronic acid may also be used as humectant.

One preferred humectant is glycerol.

1.7. Water

The lotion composition contains 6 to 25% by weight, in particular 12 to 20% by weight of water. The water contributes to a lotion-like pleasant feel on the skin of the user, for instance during blowing the nose with a treated handkerchief. Water counteracts further the tendency of pure humectants to withdraw water from the human skin. On the other hand, the water content should not be much higher than 25% by weight, since then the mechanical strength of the treated tissue paper may suffer.

It is possible to determine the water content in the lotion composition by conducting a water determination according to Karl Fischer. This may also be done with the treated tissue paper. Then the entire lotion is extracted with suitable organic solvents, such as water-free ethanol followed by the water determination of the ethanol extract according to Karl Fischer. If necessary, the residual water content of the treated tissue paper is to be subtracted.

1.8. Additives

Optionally, the lotion composition may contain up to 10% by weight, in particular 0.1 to 5% by weight additives, such as Preservatives which stabilize the lotion composition, such as methylisothiazolin(on) which may have a chlorine as substituent, e.g. 5-chloro-2-methyl-4-isothiazolin-3-on or 2-methyl-4-isothiazolin-3-on; phenoxyethanol or PHB ester, paraben preservatives, pentanediol, sorbic acid or other compounds as mentioned in "Kosmetikverordnung (Cosmetics Regulation), Anlage 4, Teil A und B".

Germicidal agent(s), e.g. those described in DE-199 06 081 A.

Cosmetic agents, preferably from natural sources (plant extracts), having for instance a skin-soothing, antiphlogistic (reduction of skin irritation), wound-healing, cell-regenerating, anti-inflammatory and/or anti-itch effect such as allantoin; aloe vera extract; chamomile extract containing azulene and (x-bisabolol; echinacea; dragosantanol; panthenol; liquorice root extract containing 18-glycyrrhetinic acid; lime tree extract containing quercetin and/or glyco-rutin; marigold (calendula oil); urea; phytosterols, optionally ethoxylated (available from Henkel under the tradename "Generol"); chitosan (acetylated chitin); anthocyanidins; ginkgo leaf extract containing quercetin and rutin; horse chestnut containing quercetin and campherol; vitamins or provitamins such as provitamin B5 or Vitamin E; avocado oil; birch extract; arnica; extract of rose of Sharon or St. John's wort; teatree oil; cucumber, hops, or hamamelis extracts or ingredients, ethoxylated quaternary amines; the use of α-bisabolol, allantoin or panthenol being preferred;

Perfume, e.g. those described in DE 199 06 081; and/or

Cosmetically useful dyes and pigments, e.g. those described in "Kosmetische Farbeemittel" (Cosmetic coloring agents), Verlag Chemie, Weinheim, 1984, p. 81

106")", published by the "Farbstoffkommission der Deutschen Farbstoffgemeinschaft".

The above additives may be used separately or in combination.

1.9. Most Preferred Lotion

The most preferred lotion composition, which based on current knowledge reflects the best mode for carrying out the invention, comprises the following components:

(A') 15–30 weight % of a liquid dialk(en)ylether, (A") 15–30 weight % of a liquid glyceride wherein glycerol is esterified with at least one carboxylic acid having from 6 to 24 carbon atoms, (B) 15–30 weight % of a liquid W/O emulsifier selected from polyol polyester wherein a polyhydric alcohol having at least two hydroxy groups is esterified with at least one acid having from 6 to 30 carbon atoms, (C) optionally 0.5 to 4 weight % wax, (D) 5 to 10 weight % humectant, (E) 12 to 20 weight % water, (F) optionally 0.5 to 5 weight % of a metal soap (G) optionally 0.5 to 7.5 weight % coemulsifier, and (H) optionally 0.1 to 5 weight % additives.

2. Preparation of Lotion

The lotion composition (water-in-oil emulsion) can be prepared according to known methods.

One procedure involves mixing and homogeneously stirring the oil phase components, such as oil components (A), emulsifier(s) (B), optionally the wax(es) (C), optionally the solid (co) emulsifier and other optional oil-soluble additives at room temperature (usually for approximately 10 min). These components are typically highly soluble and give rise to a homogeneous mixture. The components of the water phase such as water, humectant, and possible water-soluble or water-dispersible additives such as perfume or preservatives are separately mixed at room temperature and slowly added to the mixture of oil-phase components during continuous stirring. After continued stirring (preferably for approximately 10 min) the resulting mixture is then homogenized (usually for approximately 10 min) with a suitable dispersion device such as supraton or stator-rotor homogenizers of Ultraturrax type (see for instance Karlheinz Schrader, *Grundlagen und Rezepturen der Kosmetika*, H üthig Buch Verlag Heidelberg, Second Edition, 1989, pages 906 to 912). As known from the prior art, homogenizing conditions may have an impact on the viscosity of the emulsion obtained. If the viscosity is too high, which is undesirable in the present invention, it is possible for instance to reduce the energy influx during homogenization, in particular by lowering the rotational speed of the rotor/stator system.

Further, it is possible to prepare the lotion composition of the invention by mixing the oil phase and water phase components at a higher temperature. For this purpose, it is preferred to heat the oil phase and water phase components separately to about 80° C. to 85° C. Then, at this temperature the water phase components are slowly added to the oil phase components while stirring, optionally homogenizing. After continued stirring, preferably for about 5 min, the mixture is allowed to cool while stirring in such a way that it remains in continuous motion. Simultaneously, the incorporation of air should be avoided. The mixture is then homogenized with a suitable dispersion device such as supraton or stator-rotor homogenizers of Ultraturrax type, preferably at 60° to 65° C., in order to improve stability and structure. After a homogeneous state is reached, the composition is allowed to cool to room temperature.

3. Tissue Paper to be Treated

According to the invention creped or "uncreped" tissue paper obtained by wet rush transfer as described in the section "Background Art" can be lotioned, the use of creped tissue paper being preferred. The tissue paper (or the final tissue paper product obtained therefrom) can be single-ply or multi-ply (typically 2 to 6). The penetration behavior of the lotion is particular suitable for multi-ply tissues (or tissue products), in particular 4-ply embodiments as used in handkerchiefs, since the lotion can be almost evenly distributed over the outer and inner plies. The tissue paper may be homogeneous or layered, wet-pressed or blow-dried (TAD-dried). The tissue paper includes, but is not limited to, felt-pressed tissue paper, pattern-densified tissue in, paper, uncompacted tissue paper or compacted tissue paper.

The starting material for the production of the tissue paper usually is a fibrous cellulosic material, in particular pulp. If, however, linters or cotton is used as raw material for the production of tissue paper, usually no further pulping steps are needed. Due to the morphological structure, the cellulose already exists in an open state.

The starting pulps used may relate to primary fibrous materials (raw pulps) or to secondary fibrous materials, whereby a secondary fibrous material is defined as a fibrous raw material recovered from a recycling process. The primary fibrous materials may relate both to a chemically digested pulp and to mechanical pulp such as thermorefiner mechanical pulp (TMP), chemothermorefiner mechanical pulp (CTMP) or high temperature chemithermomechanical pulp (HTCTMP). Synthetic cellulose-containing fibres can also be used. Preference is nevertheless given to the use of pulp from plant material, particularly wood-forming plants. Fibers of softwood (usually originating from conifers), hardwood (usually originating from deciduous trees) or from cotton linters can be used for example. Fibres from esparto (alfa) grass, bagasse (cereal straw, rice straw, bamboo, hemp), kemp fibers, flax, and other woody and cellulosic fiber sources can also be used as raw materials. The corresponding fiber source is chosen in accordance with the desired properties of the end product in a manner known from the prior art. For example, the fibers present in hardwood, which are shorter than those of softwood, lend the final product a higher stability on account of the higher diameter/length ratio. If softness of the product is to be promoted, which is important e.g. for tissue paper, eucalyptus wood is particularly suitable as a fiber source.

With regard to softness of the products, the use of chemical raw pulps is also preferred, whereby it is possible to use completely bleached, partially bleached, and unbleached fibers. The chemical raw pulps suitable according to the invention include inter alia, sulphite pulps, kraft pulps (sulphate process).

Before a raw pulp is used in the tissue making process, it may also be advantageous to allow further delignification to occur in a separate process step or employ a bleaching process to achieve a more extensive removal of lignin after the cooking process and to obtain a completely cooked pulp.

A preferred production process for tissue paper uses a a forming section (for wet-laying a slurry of cellulosic fibrous material, typically pulp) comprising a headbox and wire portion, and b the drying section (TAD (through air drying) or conventional drying on the yankee cylinder) that also usually includes the crepe process essential for tissues.

This is typically followed by c the monitoring and winding area.

The tissue paper can be formed by placing the fibers, in an oriented or random manner, on one or between two continuously revolving wires of a paper-making machine while simultaneously removing the main quantity of water of dilution until dry-solid contents of usually between 12 and 35% are obtained. It is possible to include additives in the paper furnish to improve the wet-strength or dry-strength or other properties of the finished tissue paper.

Drying the formed primary fibrous web occurs in one or more steps by mechanical and thermal means until a final dry-solids content of usually about 93 to 97% is obtained. In the case of tissue making, this stage is followed by the crepe process which crucially influences the properties of the finished tissue product in conventional processes. The conventional dry crepe process involves creping on a drying cylinder having a diameter of usually 4.5 to 6 m , the so-called yankee cylinder, by means of a crepe doctor with the aforementioned final dry-solids content of the base ("raw tissue"). tissue paper (wet creping can be used if lower demands are made of the tissue quality). The creped, finally dry base tissue paper is then available for further processing into the paper product or tissue paper product according to the invention.

Instead of the conventional tissue making process described above, the invention gives preference to the use of a modified technique in which an improvement in specific volume is achieved by a special kind of drying within process section b and in this way an improvement in bulk softness of the resulting tissue paper is achieved. This pre-drying process, which exists in a variety of subtypes, is termed the TAD (through air drying) technique. It is characterized by the fact that the "primary" fibrous web (like a non-woven) that leaves the sheet making stage is pre-dried to a dry-solids content of about 80% before final contact drying on the yankee cylinder by blowing hot air through the fibrous web. The fibrous web is supported by an air-permeable wire or belt and during its transport is guided over the surface of an air-permeable rotating cylinder drum. Structuring the supporting imprinting fabric or belt makes it possible to produce any pattern of compressed and uncompressed zones achieved by deflection of the fibres in the moist state, followed by pre-drying (TAD step) and leading the web through a pressure nip between a pressure roll and the Yankee cylinder surface, thereby resulting in increased mean specific volumes and consequently leading to an increase in bulk softness without decisively decreasing the strength of the fibrous web.

Another possible influence on softness and strength of base tissue lies in the production of a layering in which the primary fibrous web to be formed is built up by a specially constructed headbox in the form of physically different layers of fibrous material, these layers being jointly supplied as a pulp jet to the forming stage.

The one-ply intermediate products originating from the paper-making machine and made of lightweight paper usually dry-creped on a yankee cylinder by means of a crepe doctor are generally described as "tissue paper" or more accurately base tissue paper. The one-ply base tissue may be built up of one or a plurality of layers respectively.

All one-ply or multi-ply final products made of base tissue and tailored to the end user's needs, i.e. manufactured with a wide variety of requirements in mind, are known as "tissue products".

When processing the fibrous web or base tissue paper into the final tissue product, the following procedural steps are normally used individually or in combination: cutting to size (longitudinally and/or cross cutting), producing a plurality of plies, producing mechanical and/or chemical ply adhesion, volumetric and structural embossing, folding, imprinting, perforating, application of lotions, smoothing, stacking, rolling up.

To produce multi-ply tissue paper products, such as handkerchiefs, toilet paper, towels or kitchen towels, an intermediate step preferably occurs with so-called doubling in which the base tissue in the finished product's desired number of plies is usually gathered on a common multiply master roll.

The processing step from the base tissue that has already been optionally wound up in several plies to the finished tissue product occurs in processing machines which include operations such as repeated smoothing of the tissue, edge embossing, to an extent combined with full area and/or local application of adhesive to produce ply adhesion of the individual plies (base tissue) to be combined together, as well as longitudinal cut, folding, cross cut, placement and bringing together a plurality of individual tissues and their packaging as well as bringing them together to form larger surrounding packaging or bundles. The individual paper ply webs can also be pre-embossed and then combined in a roll gap according to the foot-to-foot or nested methods.

Embossing can be used for generating ply adhesion in multi-ply tissue papers. In order to ensure that the lotion does not lower the ply adhesion, the embossed regions may be left untreated. Further it is known from U.S. Pat. No. 4,867,831 to use melted thermoplastics to achieve plybonding in lotioned tissue papers.

Tissue products using the lotioned tissue of the invention are preferably sanitary products (e.g. toilet paper), paper handkerchiefs, cosmetic wipes (facials) or as serviettes/napkins. The use in handkerchiefs is preferred.

According to the invention the tissue paper to be treated with the lotion preferably has a basis weight of 10 to 40, more preferably 12 to 20 g/m$^2$ per ply, in particular 13 to 17 g/m$^2$ and a total basis weight (including all plies without lotion) of usually 10 to 80 g/m$^2$.

4. Application of Lotion on the Tissue Paper

As mentioned, lotion application typically takes place after Iii the paper web has been dried. A suitable point in time is for example directly after drying the web, shortly before combining the webs to form multiple plies or before forming the multi-ply web into the final tissue product. However, it is preferred first to laminate at least two single ply webs to a multiply web, and then to apply the lotion. For tissue paper having two or more plies, the composition may be applied to each ply or only to one or both outer plies. In a preferred production. process for lotioned 4-ply tissue (products), two 2-ply webs are each lotioned on only one side, followed by joining together the untreated sides of said 2-ply webs, thereby obtaining a 4 ply product. Generally, it is preferred for the lotion composition to be applied to at least one, preferably both outer plies of multi-ply tissue webs, since then the advantageous penetration behavior of the lotion composition can fully be developed by achieving as even a distribution as possible with respect to the z-directidn (perpendicular) of the multi-ply tissue paper. The individual plies or the multi-ply structure may be patterned either before or after application of the lotion composition. Suitable application techniques include spraying, rotogravure printing or flexographic printing or application by means of rolls having a smooth surface. Preferably, the lotion composition is slightly heated, in particular to a temperature from 30° to 50° C., before it is applied to the paper web.

Preferably, the lotion is applied in an amount of 3 to 10 g per m$^2$ treated surface, i.e. with double the amount if both surfaces are lotioned being preferred. The weight ratio lotion composition/tissue (single or multi-ply) is preferably 10 to 40%, more preferably 21 to 35%, in particular 25 to 30%. With four-ply products a particularly good and even distribution of the lotion composition is observed when the weight ratio is from 22 to 30%, in particular 27 to 29%.

5. Example

A lotion composition containing the following ingredients was prepared at room temperature as described above.

TABLE 1

| Component | % by weight |
|---|---|
| Cocoglycerides | 20.4 |
| Dicaprylylether | 20.4 |
| Polyglyceryl-poly (12-hydroxy-stearate) (PGPH) | 20.4 |
| Sorbitan sesquioleate | 4.8 |
| Cera alba (Bees wax) | 3.4 |
| Dicocoyl pentaerythrityl distearyl-citrate (DPDC) | 2.0 |
| Aluminium stearate | 3.4 |
| Bisabolol | 1.5 |
| Glycerol (99.5%) | 7.0 |
| Perfume | 0.5 |
| Preservatives (methylchloroisothiazoline/ methylisothiazolinone (3/1)) | 0.1 |
| Water | ad 100 |

The lotion composition had a viscosity of about 3000 mPa·s at 23° C. (measured with a Brookfield-RVF viscosimeter, spindle 5, 10 rpm).

This lotion composition was heated to about 40° C. and applied with a rotogravure device to both sides of a 4-ply web in an amount of 7 g/m$^2$ each. Then, the 4-ply web was separated again in the four individual webs and adhesive was sprayed on corresponding portions of three webs. The adhesively coated webs were again joined together, thereby obtaining a laminated four-ply web having lotion on both outer sides (total amount of lotion 14 g m$^2$). The corresponding, but untreated 4-ply web has a basis weight of 61.2 g/m$^2$, a thickness of 0.34 mm, and a bulk of 5.6 cm$^3$/g. This leads to an amount of 22.8% by weight lotion based on-the weight of the four-ply tissue.

The penetration behavior of the lotion was determined as follows. A sample having a weight of 60g was taken from the lotioned four-ply web. This sample was separated into individual plies. Each resulting ply sample was extracted with 300 ml ethanol in a Soxhlet apparatus (78° C., 6h) followed by an extraction by means of 300 ml dichloromethane also in a Soxhlet apparatus (40° C., 6h). These extractions were carried out immediately upon application of the lotion composition, and then repeated with new test samples obtained in the same manner from the treated 4-ply web after two hours, after one day, and after seven days.

The amount of lotion contained in the individual plies was taken to be the sum of ethanol and dichloromethane extract residues, after evaporation of solvents (it should be noted that this determination does not cover the water content of the lotion, which however can be determined according to the Fischer method mentioned above).

The results obtained are shown in Table 2 below.

TABLE 2

| Sample | | 0 h | 2 h | 1 day | 7 days |
|---|---|---|---|---|---|
| 1 st ply | Ethanol | 12.00% | 13.50% | 16.60% | 14.90% |
| | DCM | 6.20% | 6.40% | 9.30% | 2.70% |
| | Lotion | 18.20% | 19.90% | 25.90% | 17.60% |
| 2 nd ply | Ethanol | 6.10% | 7.30% | 9.20% | 10.50% |
| | DCM | 1.10% | 1.60% | 1.70% | 2.70% |
| | Lotion | 7.30% | 9.80% | 10.90% | 13.10% |
| 3 rd ply | Ethanol | 2.90% | 7.90% | 9.00% | 9.80% |
| | DCM | 0.80% | 1.80% | 1.90% | 3.30% |
| | Lotion | 3.70% | 9.70% | 10.90% | 13.10% |
| 4 th ply | Ethanol | 17.50% | 15.70% | 13.80% | 12.20% |
| | DCM | 9.40% | 6.60% | 4.70% | 5.30% |
| | Lotion | 26.90% | 22.30% | 18.50% | 17.50% |

It is shown that already after seven days the lotion of the invention almost fully penetrates the inner plies. The difference in lotion composition between the outer (first and fourth ply) and inner (second and third ply) lotion content at this time is about 20 to 30% based on the lotion content of the outer plies. It is expected that this difference will further decrease, if the lotioned tissue web is stored for a time longer than seven days.

The lotioned tissue paper of the invention further demonstrated an excellent surface softness and bulk softness in particular. At the same time, it was capable of efficiently transferring lotion to the skin of the user.

What is claimed is:

1. Tissue paper penetrated with an effective amount of a lotion composition to soften the paper, said composition being a liquid, viscous water-in-oil emulsion and comprising:

(A) 20 to 75 weight % of at least one oil, (B) 3 to 40 weight % of at least one non-ionic water-in-oil emulsifier, (C) optionally 0.5 to 10 weight % of at least one wax, (D) 1 to 15 weight % of at least one humectant, (E) 6 to 25 weight % of water, wherein the weight % values relate to the total weight of the lotion composition.

2. Tissue paper according to claim 1, wherein the oil component (A) comprises at least one oil (A') having a viscosity lower than 30 mPa·s measured with a Hoppler falling sphere viscosimeter at 20° C. (method DGF C-IV 7).

3. Tissue paper according to claim 1, wherein the oil component (A) comprises at least one liquid oil (A') selected from symmetric or asymmetric dialk(en)ylethers having from 12 to 24 C atoms and a linear or branched dialk(en) ylcarbonate derived from C 6 to 22 fatty alcohols.

4. Tissue paper according to claim 1, wherein the oil component (A) comprises at least one oil (A") having a viscosity greater than 30 mPa·s and not more than 100 mPa·s measured with a Hoppler falling sphere viscosimeter at 20° C. (method DGF C-IV 7).

5. Tissue paper according to claim 1, wherein the oil component (A) comprises at least one liquid oil (A") selected from glycerides, glyceride-based natural oils and hydrocarbon based oils.

6. Tissue paper according to claim 1, wherein the oil component (A) comprises a mixture of at least one liquid oil (A') selected from symmetric or asymmetric dialk(en) ylethers having from 12 to 24 C atoms and linear or branched dialk(en)ylcarbonates derived from C 6 to 22 fatty alcohols and at least one liquid oil (A") selected from glycerides, natural oils and hydrocarbon based oils.

7. Tissue paper according to claim 1, wherein the non-ionic emulsifier (B) comprises a liquid polyol polyester wherein a polyhydric alcohol having at least two hydroxy groups is esterified with at least one acid having from 6 to 30 carbon atoms.

8. Tissue paper according to claim 7, wherein said polyol polyester is polyglyceride poly(12-hydroxystearate).

9. Tissue paper according to claim 1, wherein the lotion composition further comprises a liquid ester of a sugar alcohol or anhydride thereof as coemulsifier.

10. Tissue paper according to claim 1, wherein the composition contains more than 0.5, but less than 5 weight % wax.

11. Tissue paper according to claim 1, wherein the humectant is glycerol.

12. Tissue paper according to claim 1, wherein the weight ratio of lotion composition to tissue paper is 10 to 40%.

13. Tissue paper according to claim 1, wherein the lotion composition comprises:

(A') 15 to 30 weight % of a liquid dialk(en)ylether having from 12 to 24 carbon atoms, (A") 15 to 30 weight % of a liquid glyceride wherein glycerol is esterified with at least one acid having from 6 to 24 carbon atoms, (B) 15 to 30 weight % of a water-in-oil emulsifier selected from liquid polyol polyester wherein a polyhydric alcohol having at least two hydroxy groups is esterified with at least one acid having from 6 to 30 carbon atoms, (C) 0.5 to 4 weight % wax, (D) 5 to 10 weight % humectant, (E) 12 to 20 weight % water, (F) optionally 0.5 to 5 weight % of a metal soap (G) optionally up to 15 weight % of at least one coemulsifier, (H) optionally 0.1 to 5 weight % additives.

* * * * *